US006653586B2

(12) United States Patent
Hsiung et al.

(10) Patent No.: US 6,653,586 B2
(45) Date of Patent: Nov. 25, 2003

(54) KEY STRUCTURE

(75) Inventors: I Hsiung, Hsing-Ping (CN); Chi-Jen Hsueh, Taipei (TW)

(73) Assignee: Industrial Technology Research Institute, Hsinchu (TW)

( * ) Notice: Subject to any disclaimer, the term of this patent is extended or adjusted under 35 U.S.C. 154(b) by 2 days.

(21) Appl. No.: 10/112,709

(22) Filed: Apr. 2, 2002

(65) Prior Publication Data

US 2003/0106780 A1 Jun. 12, 2003

(30) Foreign Application Priority Data

Dec. 11, 2001 (TW) ..... 90221520 U

(51) Int. Cl.[7] ..... H01H 13/70
(52) U.S. Cl. ..... 200/517; 200/512
(58) Field of Search ..... 200/5 A, 512, 200/513, 517, 341, 345; 400/490, 491, 491.2, 495, 495.1, 496

(56) References Cited

U.S. PATENT DOCUMENTS

| | | | | | |
|---|---|---|---|---|---|
| 5,117,076 | A | * | 5/1992 | Damitio | 200/344 |
| 5,247,143 | A | * | 9/1993 | Suwa | 200/517 |
| 5,306,886 | A | * | 4/1994 | Yamada | 200/517 |
| 5,565,865 | A | * | 10/1996 | So | 341/20 |
| 5,612,692 | A | | 3/1997 | Dugas et al. | 341/22 |
| 5,729,221 | A | * | 3/1998 | Krolopp et al. | 341/22 |

* cited by examiner

*Primary Examiner*—Michael Friedhofer
(74) *Attorney, Agent, or Firm*—Birch, Stewart, Kolasch & Birch, LLP

(57) ABSTRACT

A keyboard key structure adopted for use on a larger sized key to provide users more effective depressing movements on the key includes two elastic domes to support a key cap in a non-depressed position. The two elastic domes are designed in an unsymmetrical fashion to equip with different compression displacements and flexibility and enable the key cap to move in one direction to reach a depressed position and complete signal input.

8 Claims, 5 Drawing Sheets

KEY STRUCTURE

FIELD OF THE INVENTION

The invention relates to a key structure adopted for use on a larger size key, and particularly to a key that can generate an indicating light to achieve effective depressing movements and indicate current key conditions.

BACKGROUND OF THE INVENTION

A keyboard generally consists of a plurality of keys to serve as a communication interface to an electronic data processing apparatus (such as a computer). Keyboard structures are constantly evolving and new features and functions continuously added. For instance:

First, every key on the keyboard inputs a preset signal when depressed once and automatically returns to its original position when released. To make the return movement possible, the general approach is to install a spring under the key. Taking the keyboard of a personal computer as an example, every keyboard has more than one hundred keys, including numeral keys, character keys and function keys. Hence more than one hundred springs have to be installed. Such a design increases costs for the springs, and also increases assembly time. To resolve this problem, some producers have designed an elastic plate with elastic domes corresponding to key positions. The elastic plate is made from material such as rubber by integrated injection forming processes. The rubber has rich elasticity, thus the elastic domes may be used to replace the springs. Through integrated injection forming processes, production costs and assembly time can be greatly reduced.

Second, with a growing number of application software on the market, hot keys are added on the keyboards in addition to the numeral keys, character keys and function keys to facilitate user operations of the application software. For example, to link to networks used to require many steps. Now, through the design of the hot keys, linking to networks can be accomplished by a single push on a selected hot key.

Third, many keyboards have illumination design to enable users to operate easier in circumstances where ambient light is not sufficient. The light sources used are mostly light emitting diodes. Depending on illuminating methods, some illuminating keys adopt constant lighting while others adopt an on/off approach based on key operations.

The Hot keys mentioned above generally have a larger size than conventional keys. The elastic plate to provide elastic force for the Hot Keys should also have elastic domes of a larger size. While this can easily be done through injection forming process, the larger size of the elastic dome made from rubber causes reduced flexibility (the elastic dome becomes softer). As a result, return elasticity decreases. When using a single elastic dome to match a key of a larger size, because the elastic becomes softer, the depression location on the key of a user's finger can affect the compression direction of the elastic dome and result in ineffective depression.

Moreover, for illuminating keys, the light sources are generally located between the circuit board and elastic plate. To design keys that are turned on or off depending on key operations, the light sources must match key locations. However the elastic plate tends to obstruct light projection of the light sources and causes reduction of light intensity. U.S. Pat. No. 5,612,692 discloses a design for illuminating keys. The illuminating key includes a key cap and an elastic dome located under the key. That patent has a complex structure, and the light source is located on a position biased to the key. Only a small portion of the key is illuminated. Moreover, light generated by lighting elements has to pass through the media of the elastic dome and key cap. Thus the illuminating effect is undesirable.

The conventional techniques set forth above either have complex structures and designs for larger size or illuminating keys, cannot provide effective depression, or have complicated manufacturing processes and higher production costs. The higher costs and complicated production processes become huge disadvantages for the electronic industry, which has to wrestle with the challenges of continuous price reduction and increasing demands for shorter research and development cycles. Improved designs for keys to simplify production processes and reduce production costs are critical technical issues yet to be overcome.

SUMMARY OF THE INVENTION

The primary object of the invention is to provide a key structure for larger size and illuminating keys.

The key structure according to the invention consists of a key cap and two elastic domes. The key cap has a bottom rim which has two lugs located on two sides thereof The two elastic domes hold and support the lugs of the key cap in a non-depressed position. The two elastic domes have different compression displacements and flexibility to allow the cap to move in a selected direction to reach a depressed position and accomplish signal input.

The key structure according to the invention has a lighting element on the circuit board located between two elastic domes to allow light to directly project through the key cap without the obstruction of the elastic domes.

The foregoing, as well as additional objects, features and advantages of the invention will be more readily apparent from the following detailed description, which proceeds with reference to the accompanying drawings. The drawings are only to serve for reference and illustrative purposes, and are not intended to limit the scope of the invention.

DESCRIPTION OF THE PREFERRED EMBODIMENTS

Figure 1:
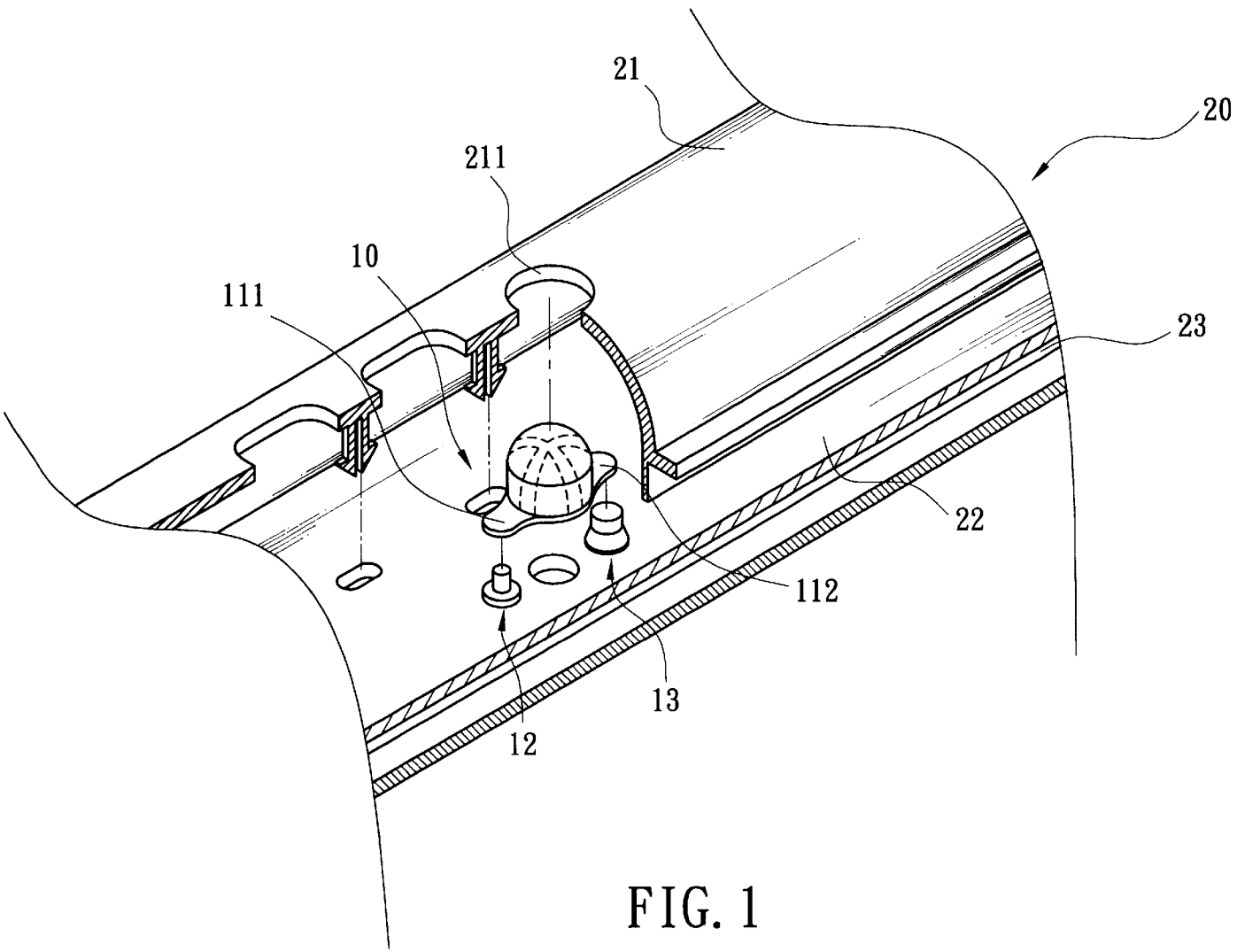
FIG. 1 is a pictorial view of the invention, partly cut away.
Figure 2:
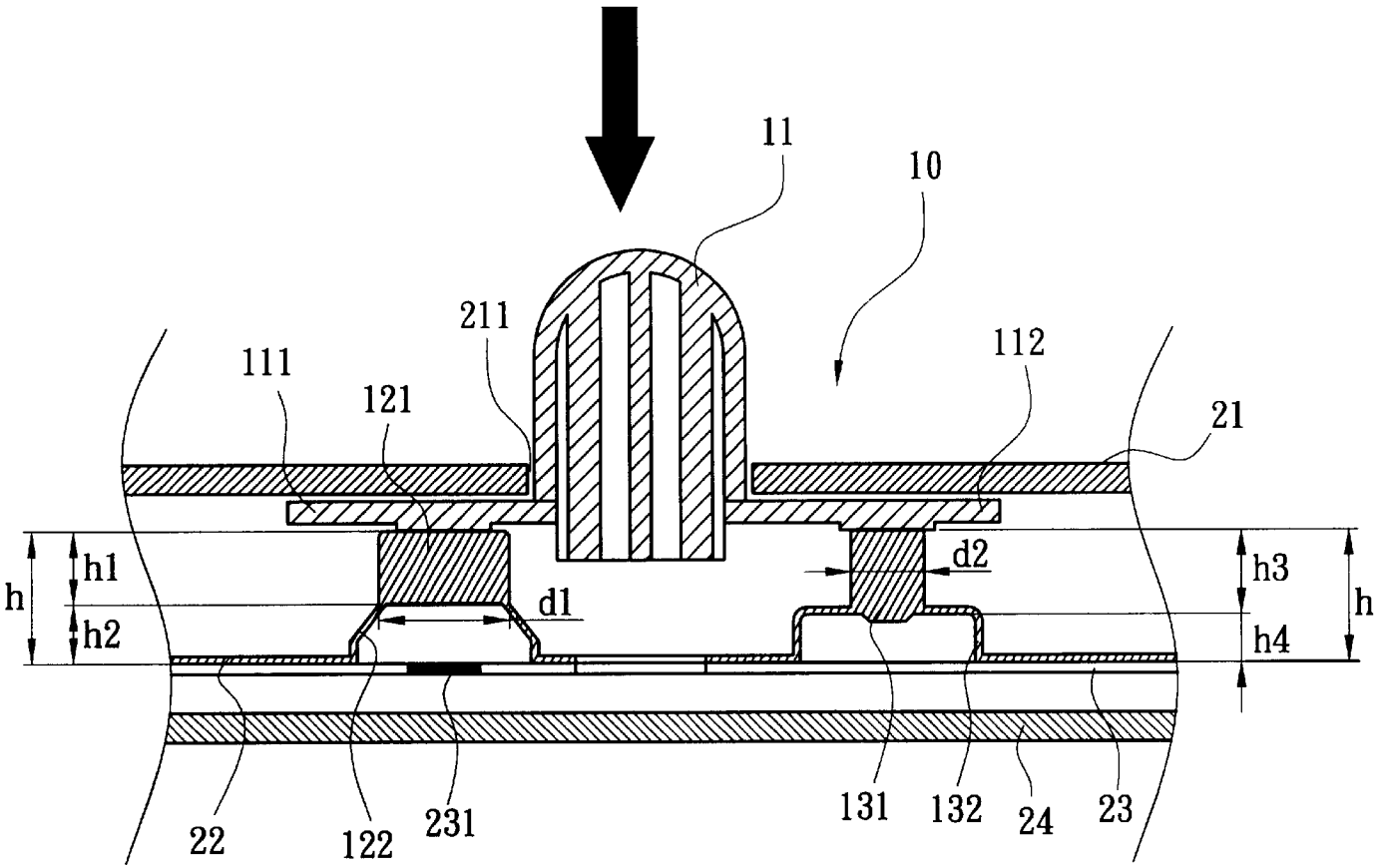
FIG. 2 is a sectional view of the invention.

Referring to FIGS. 1 and 2, the key structure of the invention is located on a keyboard 20. The keyboard 20 includes an upper casing 21, a plurality of keys (only one key 10 is shown in the drawings), an elastic plate 22, a membrane circuit board 23 and a lower casing 24. The upper casing 21 has an aperture 211 for the key 10 to pass through and extend outside for users to depress with a finger. The elastic plate 22 is made from a flexible material such as rubber by injection forming processes to keep the key 10 extending outside the aperture 211 in a non-depressed position, and to provide a returning elastic force when the key 10 is depressed (will be discussed later). The membrane circuit board 23 has connecting circuits (not shown in the drawings) and electric contacts 231. Every key 10 corresponds to one electric contact. When the key 10 is depressed, it connects the electric contact 231 of the circuit board 23 to output a preset signal.

The key 10 according to the invention includes a key cap 11, a first elastic dome 12 and a second elastic dome 13. The key cap 11 is located in the aperture 211 of the upper casing 21, and has a bottom rim that has a pair of lugs 111 and 112 located on two sides thereof. The lugs 111 and 112 are retained by the edges of the aperture 211 to prevent the key cap 11 from escaping from the aperture 211.

The first elastic dome 12 and second elastic dome 13 are integrally formed with the elastic plate 22 by injection forming processes, and correspond respectively to the lugs 111 and 112 of the key cap 11. The first elastic dome 12 includes a first supporting section 121 and a first elastic section 122. The first supporting section 121 has a diameter d1 and a height h1, and the first elastic section 122 has a height h2. The second elastic dome 13 has the same height h as the first elastic dome 12, and includes a second supporting section 131 and a second elastic section 132. The second supporting section 131 has a diameter d2 and a height h3, and the second elastic section 132 has a height h4, wherein d1>d2, and h2>h4. That is, the diameter of the bottom rim of the first elastic dome 12 is greater than that of the second elastic dome 13, and the height of the first elastic section 122 of the first elastic dome 12 is greater than that of the second elastic section 132 of the second elastic dome 13. Hence the second elastic dome 13 has greater flexibility than the first elastic dome 12. In terms of depression effect, the first elastic dome 12 is softer while the second elastic dome 13 is harder. In addition, the first elastic dome 12 has a longer compression displacement (h2) than that (h4) of the second elastic dome 13.

Figure 3A:
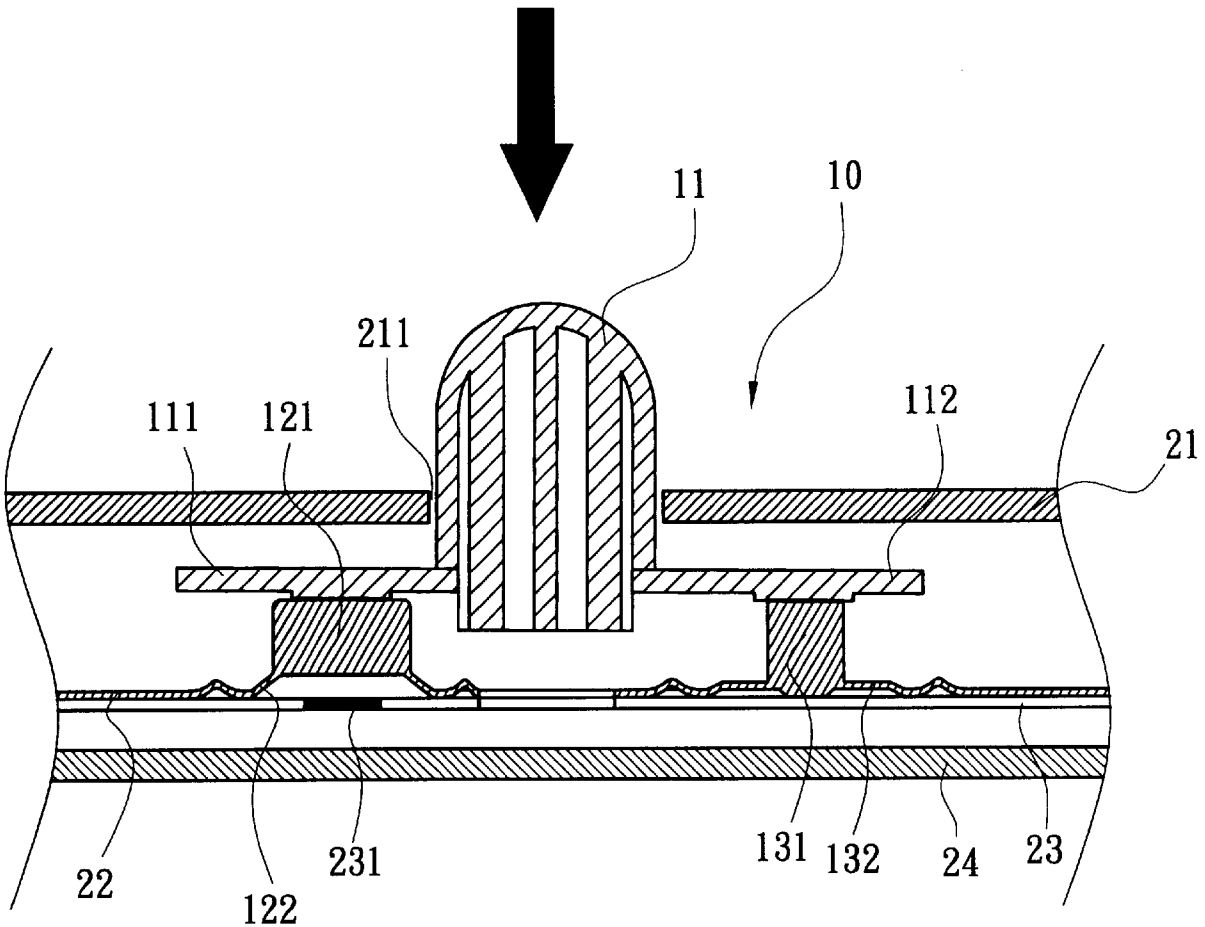
FIGS. 3A and 3B are schematic views of the invention in various operating conditions.
Figure 3B:
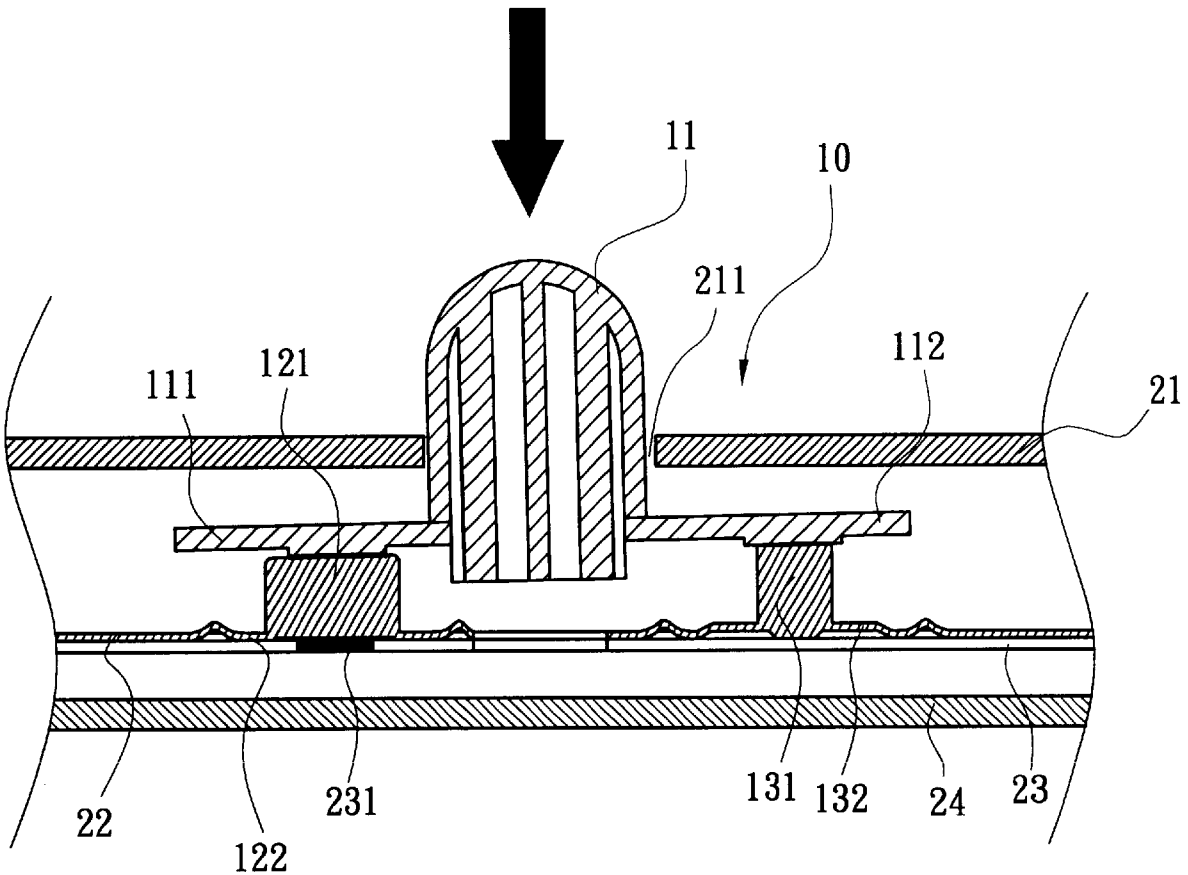

Referring to FIGS. 2, 3A and 3B, in normal conditions, the first elastic dome 12 and the second elastic dome 13 jointly support the key cap 11 in a non-depressed position (as shown in FIG. 2). When there is a force applied to the key cap 11, the key cap 11 is moved downwards. The first and second elastic sections 122 and 132 of the first and second elastic domes 12, 13 are pressed downwards. As the compression displacement (h4) of the second elastic dome 13 is shorter than that (h2) of the first elastic dome 12, the second elastic section 132 of the second elastic dome 13 is completely compressed first and cannot be moved downwards further (as shown in FIG. 3A) while the first elastic dome 12 is being moved downwards continuously. That is, the key cap 11 is continuously moved downwards in the direction of the first elastic dome 12 until the first elastic dome 12 touches the electric contact 231 and reaches the depressed position of the key cap 11 to output a preset signal. When the depression force on the key cap 11 is released, the first elastic dome 12 and the second elastic dome 13 return to their original conditions, and the key cap 11 returns to the non-depressed position.

When adopting the key structure of the invention to keys of larger sizes, the design of different compression displacements and different flexibility of the first elastic dome 12 and second elastic dome 13 allow depression movements to shift in one direction and to make depression movement more effective for completing signal output.

Figure 4:
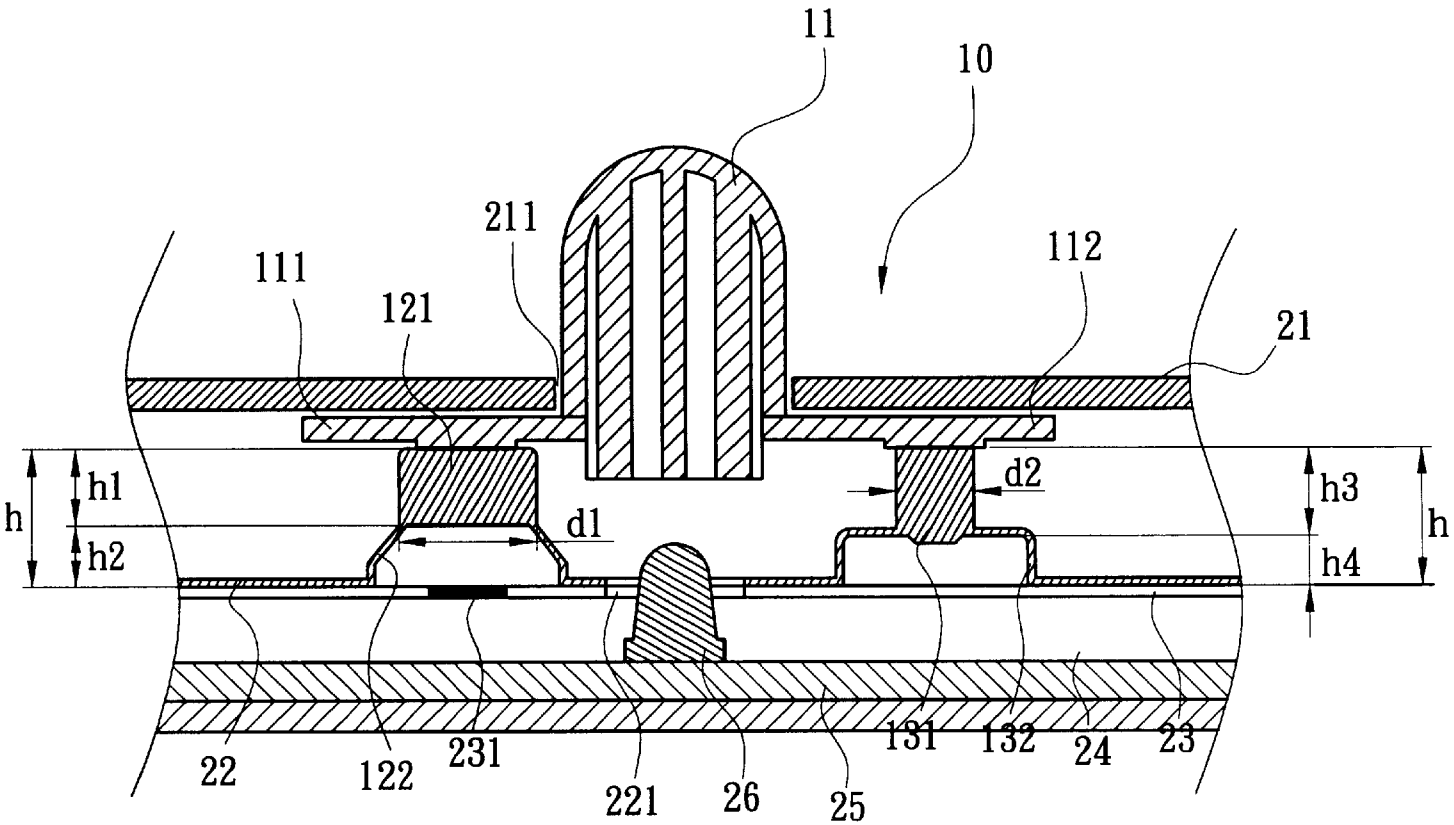
FIG. 4 is a schematic view of an embodiment of the invention.

While the embodiment set forth above is adopted for keys of larger sizes, it may be adopted equally well for illuminating keys and can generate a better illuminating effect. As shown in FIG. 4, to achieve the object of illumination, the key 10 further includes a circuit board 25, which has a lighting element 26 located on a position corresponding to the key cap 11. The lighting element may be a light emitting diode or other light emitting elements. As the key cap 11 is jointly supported by the first elastic dome 12 and the second elastic dome 13, the elastic plate 22 may have an opening 221 formed between the first elastic dome 12 and the second elastic dome 13 to allow light generated by the lighting element 26 to pass through. The key cap 11 may be made from transparent material. When the key cap 11 is depressed and electric connection is established, the light element 26 immediately emits light to indicate current conditions. When the depression force is released from the key cap 11, the light element 26 is turned off. Hence through the design of the first elastic dome 12 and second elastic dome 13 set forth above, light generated by the lighting element 26 can directly pass through the key cap 11 without being obstructed, and thus achieve an optimum illuminating effect.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A key structure located in a keyboard for outputting a preset signal, comprising:

a key cap located on the keyboard, which has an un-depressing position and a depressed position;

a first elastic dome located on one side of the key cap for holding the key cap in the un-depressing position in normal conditions, which has elasticity to return the key cap to the un-depressing position after being depressed; and a second elastic dome located on another side of the key cap opposite to the first elastic dome for jointly holding the key cap with the first elastic dome in the un-depressing position in normal conditions, which has elasticity to return the key cap to the un-depressing position after being depressed, the second elastic dome having a compression displacement shorter than that of the first elastic dome to allow the key cap moving down towards a direction of the first elastic dome until reaching the depressed position for outputting the preset signal.

2. The key structure of claim 1, wherein the keyboard further includes an upper casing, an elastic plate and a lower casing.

3. The key structure of claim 2, wherein the upper casing has an aperture to allow the key cap to pass through.

4. The key structure of claim 2, wherein the elastic plate is made from rubber by integrated injection forming processes.

5. The key structure of claim 4, wherein the elastic plate is integrally formed with the first elastic dome and the second elastic dome by the injection forming processes.

6. The key structure of claim 1, wherein the key cap has a bottom rim having a pair of lugs located on two sides thereof for resting on the first and the second elastic domes.

7. The key structure of claim 1, wherein the first elastic dome and the second elastic dome have respectively a supporting section and an elastic section, the supporting section of the first elastic dome having a diameter greater than that of the supporting section of the second elastic dome, and the elastic section of the first elastic dome having a height greater than that of the elastic section of the second elastic dome.

8. The key structure of claim 1, wherein the keyboard further includes a circuit board equipped with a lighting element which corresponds to the key cap; the key cap being transparent; the lighting element generating light when the key cap being moved to the depressed position and turning off the light when the key cap being moved away from the depressed position; the elastic plate having an aperture located between the first elastic dome and the second elastic dome and corresponding to the lighting element for allowing the lighting element to pass through.

* * * * *